US012571537B2

(12) United States Patent
Ozaki et al.

(10) Patent No.: US 12,571,537 B2
(45) Date of Patent: Mar. 10, 2026

(54) COMBUSTOR PANEL AND GAS TURBINE COMBUSTOR INCLUDING SAME

(71) Applicant: KAWASAKI JUKOGYO KABUSHIKI KAISHA, Kobe (JP)

(72) Inventors: Yoshihiko Ozaki, Kobe (JP); Koichi Nozaki, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 18/724,248

(22) PCT Filed: Dec. 22, 2022

(86) PCT No.: PCT/JP2022/047420
§ 371 (c)(1),
(2) Date: Jun. 26, 2024

(87) PCT Pub. No.: WO2023/127691
PCT Pub. Date: Jul. 6, 2023

(65) Prior Publication Data

US 2025/0060104 A1 Feb. 20, 2025

(30) Foreign Application Priority Data

Dec. 27, 2021 (JP) ..... 2021-211922

(51) Int. Cl.
*F23R 3/00* (2006.01)

(52) U.S. Cl.
CPC ..... *F23R 3/002* (2013.01); *F23R 3/007* (2013.01)

(58) Field of Classification Search
CPC ..... F23R 3/002; F23R 3/007
See application file for complete search history.

(56) References Cited

U.S. PATENT DOCUMENTS 4,422,300 A 12/1983 Dierberger et al.
4,441,324 A * 4/1984 Abe ..... F23R 3/007 60/753

(Continued)

FOREIGN PATENT DOCUMENTS

EP 0943867 A1 9/1999
EP 3712392 A1 9/2020

(Continued)

OTHER PUBLICATIONS

International Search Report for PCT/JP2022/047420 dated Feb. 28, 2023 (PCT/ISA/210).

*Primary Examiner* — Devon C Kramer
*Assistant Examiner* — Henry Ng
(74) *Attorney, Agent, or Firm* — Sughrue Mion, PLLC

(57) ABSTRACT

A panel of a combustor includes: an outer surface that is opposed to an inner peripheral surface of a shell so as to be spaced apart from the inner peripheral surface; and an inner surface that defines a combustion chamber extending in a flow direction from an upstream side of the combustor to a downstream side of the combustor. At least part of a neutral plane between the outer surface and the inner surface has a planar shape or a curved surface shape which extends in a circumferential direction and whose curvature is smaller than a curvature of a virtual circular arc that is concentric with the inner peripheral surface of the shell.

6 Claims, 11 Drawing Sheets

(56) References Cited

U.S. PATENT DOCUMENTS

| | | | | |
|---|---|---|---|---|
| 4,567,730 | A * | 2/1986 | Scott | F23R 3/002 60/753 |
| 4,688,310 | A * | 8/1987 | Kelm | F23R 3/002 29/889.22 |
| 4,838,030 | A * | 6/1989 | Cramer | F23R 3/007 60/753 |
| 4,838,031 | A * | 6/1989 | Cramer | F23R 3/007 60/753 |
| 5,333,443 | A | 8/1994 | Halila | |
| 6,361,273 | B1 * | 3/2002 | Eng | F01D 11/08 415/173.1 |
| 8,141,371 | B1 | 3/2012 | Habarou et al. | |
| 2007/0062198 | A1 * | 3/2007 | Huth | F23R 3/005 60/758 |
| 2007/0256418 | A1 * | 11/2007 | Mueller | F23R 3/00 60/752 |
| 2012/0073306 | A1 | 3/2012 | Habarou et al. | |
| 2014/0033723 | A1 * | 2/2014 | Doerr | F23R 3/045 60/737 |
| 2014/0250894 | A1 | 9/2014 | Petty, Sr. et al. | |
| 2015/0176843 | A1 * | 6/2015 | Garry | F23M 5/04 60/753 |
| 2016/0016230 | A1 * | 1/2016 | Campomanes | B29C 35/02 264/118 |
| 2016/0320060 | A1 * | 11/2016 | Chang | F23R 3/50 |
| 2017/0138596 | A1 * | 5/2017 | Freeman | F23R 3/10 |
| 2017/0276363 | A1 * | 9/2017 | Berry | F23R 3/46 |
| 2017/0356653 | A1 * | 12/2017 | Bagchi | F23R 3/002 |
| 2018/0128486 | A1 * | 5/2018 | Burd | F23R 3/002 |
| 2019/0264923 | A1 | 8/2019 | Kobayashi et al. | |
| 2020/0003419 | A1 * | 1/2020 | Moore | F23R 3/002 |
| 2020/0348024 | A1 * | 11/2020 | Hicks | F23R 3/50 |
| 2020/0355369 | A1 * | 11/2020 | Hu | F23R 3/007 |
| 2021/0325043 | A1 * | 10/2021 | Freeman | F23R 3/46 |

FOREIGN PATENT DOCUMENTS

| | | | |
|---|---|---|---|
| JP | 2006-214686 | A | 8/2006 |
| JP | 2009-293914 | A | 12/2009 |
| JP | 2013-104602 | A | 5/2013 |
| WO | 2018/087878 | A1 | 5/2018 |

* cited by examiner

COMBUSTOR PANEL AND GAS TURBINE COMBUSTOR INCLUDING SAME

CROSS REFERENCE TO RELATED APPLICATIONS

This application is a National Stage of International Application No. PCT/JP2022/047420 filed Dec. 22, 2022, claiming priority based on Japanese Patent Application No. 2021-211922 filed Dec. 27, 2021, the entire contents of which are incorporated in their entirety.

TECHNICAL FIELD

The present disclosure relates to a combustor panel made of a ceramic matrix composite and a gas turbine combustor including the combustor panel.

BACKGROUND ART

To realize high-temperature high-pressure combustion for the purpose of the improvement of fuel efficiency, the improvement of heatproof temperatures of parts of combustors of gas turbines are required. Conventionally, a panel defining a combustion chamber of the combustor is made of metal and is cooled by air during the operation of the gas turbine.

PTL 1 discloses that the panel of the combustor is made of a ceramic matrix composite (CMC). The CMC is lighter than metal. Since the heatproof temperature of the CMC is high, the amount of cooling air can be reduced while realizing high-temperature high-pressure combustion. Therefore, when the panel is made of the CMC, the fuel efficiency of the gas turbine improves.

CITATION LIST

Patent Literature

PTL 1: International Publication No. 2018/087878

SUMMARY OF INVENTION

Technical Problem

The CMC panel has a high heatproof temperature and is used at a position facing the combustion chamber. Therefore, high-temperature heat from the combustion chamber is input to an inner peripheral surface of the CMC panel. In the CMC panel, a thermal gradient from the inner peripheral surface toward an outer peripheral surface is generated. Therefore, in the CMC panel, thermal stress is generated by the heat of the combustion chamber. Thus, a reduction in the thermal stress of the CMC panel is required.

An object of one aspect of the present disclosure is to reduce thermal stress generated in a CMC panel of a combustor of a gas turbine by heat of a combustion chamber.

Solution to Problem

A panel of a combustor according to one aspect of the present disclosure is a panel of a combustor of a gas turbine, the panel being one of panels located inside a cylindrical shell of the combustor and lined up in a circumferential direction of the shell, the panel including a ceramic matrix composite. The panel includes: an outer surface that is opposed to an inner peripheral surface of the shell so as to be spaced apart from the inner peripheral surface of the shell; and an inner surface that defines a combustion chamber extending in a flow direction from an upstream side of the combustor to a downstream side of the combustor. At least part of a neutral plane between the outer surface and the inner surface has a planar shape or a curved surface shape which extends in the circumferential direction and whose curvature is smaller than a curvature of a virtual circular arc that is concentric with the inner peripheral surface of the shell.

A combustor of a gas turbine according to one aspect of the present disclosure includes: a cylindrical shell; and panels which are the above panels, are located inside the shell, are located in a circumferential direction, and are made of a ceramic matrix composite.

Advantageous Effects of Invention

According to one aspect of the present disclosure, at least part of the panel made of the ceramic matrix composite has a flat plate shape or a shape similar to a flat surface. Therefore, restrictions by the shape of the panel are reduced, and thermal stress generated in the panel by the heat of the combustion chamber can be reduced.

DESCRIPTION OF EMBODIMENTS

Hereinafter, embodiments will be described with reference to the drawings. In the following description, a direction orthogonal to a center axis X of a gas turbine 1 is referred to as a radial direction R, and a direction around the center axis X is referred to as a circumferential direction C. Moreover, in a flow direction F in a combustion chamber 9, a side where a fuel injector 10 is located is referred to as an upstream side, and a side where an exhaust port 9*a* is located is referred to as a downstream side.

Embodiment 1

Figure 1:
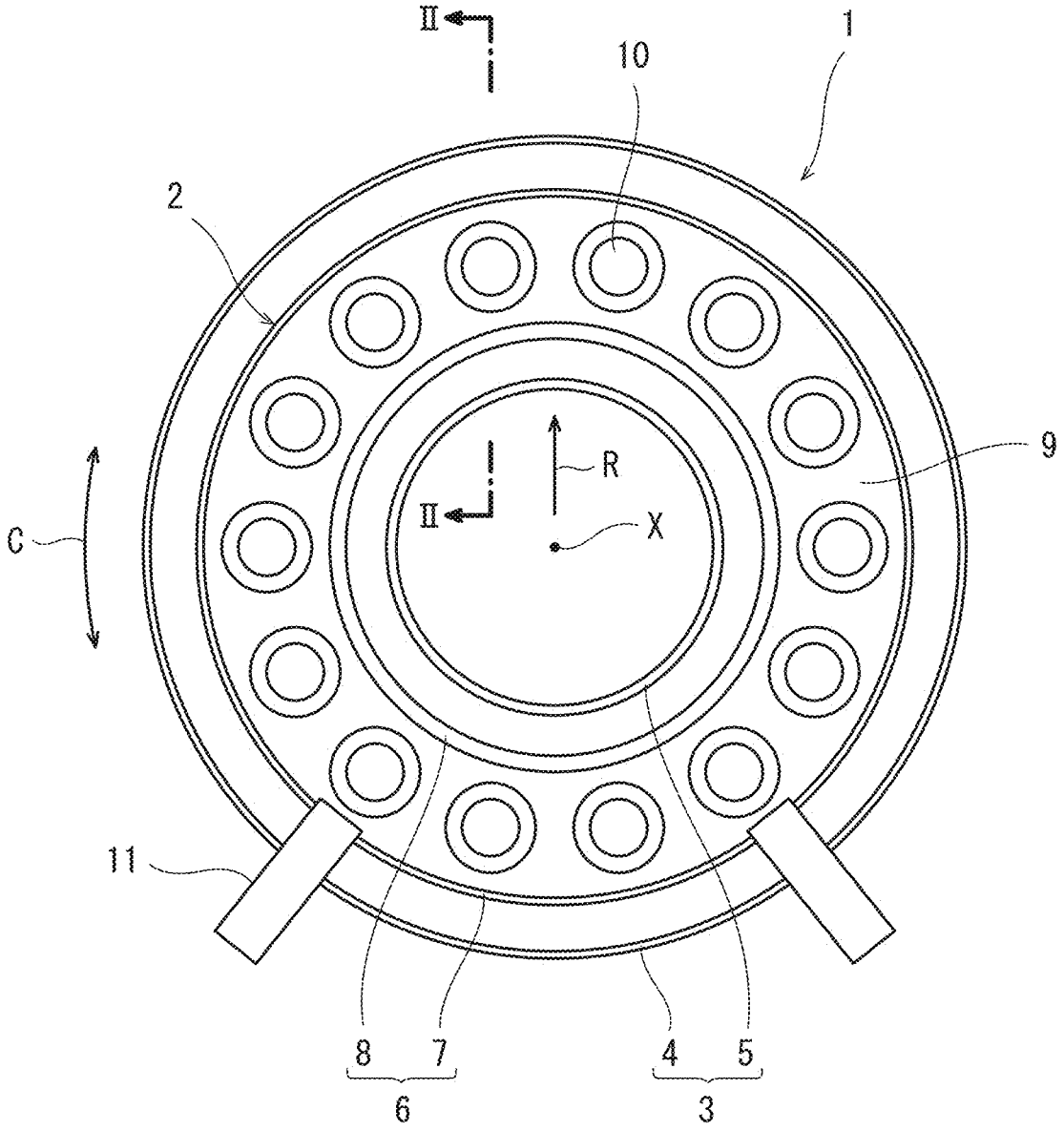
FIG. 1 is a sectional view showing a combustor of a gas turbine according to Embodiment 1 when viewed from a downstream side in a flow direction.

FIG. 1 is a schematic diagram showing a combustor 2 of the gas turbine 1 according to Embodiment 1 when viewed from the downstream side in the flow direction. The combustor 2 is a combustor of the gas turbine 1 used as an aircraft engine. The combustor 2 mixes compressed air, supplied from a compressor, with fuel to generate a fuel-air mixture, and combusts the fuel-air mixture. Thus, the combustor 2 generates a high-temperature high-pressure combustion gas. The generated combustion gas is supplied to a turbine to drive the turbine.

For example, the combustor 2 is of an annular type formed in an annular shape surrounding the center axis X of the gas turbine 1. The combustor 2 may be of a type other than the annular type. The combustor 2 includes a casing 3. The casing 3 includes an annular outer casing 4 and an annular inner casing 5 which is concentrically located inside the outer casing 4. An annular internal space is defined by the outer casing 4 and the inner casing 5. A shell 6 is located in the annular internal space of the casing 3 and is a combustion liner that is concentric with the casing 3. The shell 6 includes an annular outer shell 7 and an annular inner shell 8 which is concentrically located inside the outer shell 7. An annular space surrounded by the outer shell 7 and the inner shell 8 is utilized as the combustion chamber 9. In a section viewed in the circumferential direction C, the outer shell 7 and the inner shell 8 extend linearly from the upstream side toward the downstream side.

Fuel injectors 10 that inject the fuel into the combustion chamber 9 are located annularly along the combustion chamber 9 at the upstream side of the combustion chamber 9. The fuel injectors 10 are lined up at regular intervals in the circumferential direction C on a virtual circle that is concentric with the shell 6. Ignition plugs 11 are located at the shell 6 and generate sparks to ignite the fuel-air mixture in the combustion chamber 9 at the start of the gas turbine 1.

Figure 2:
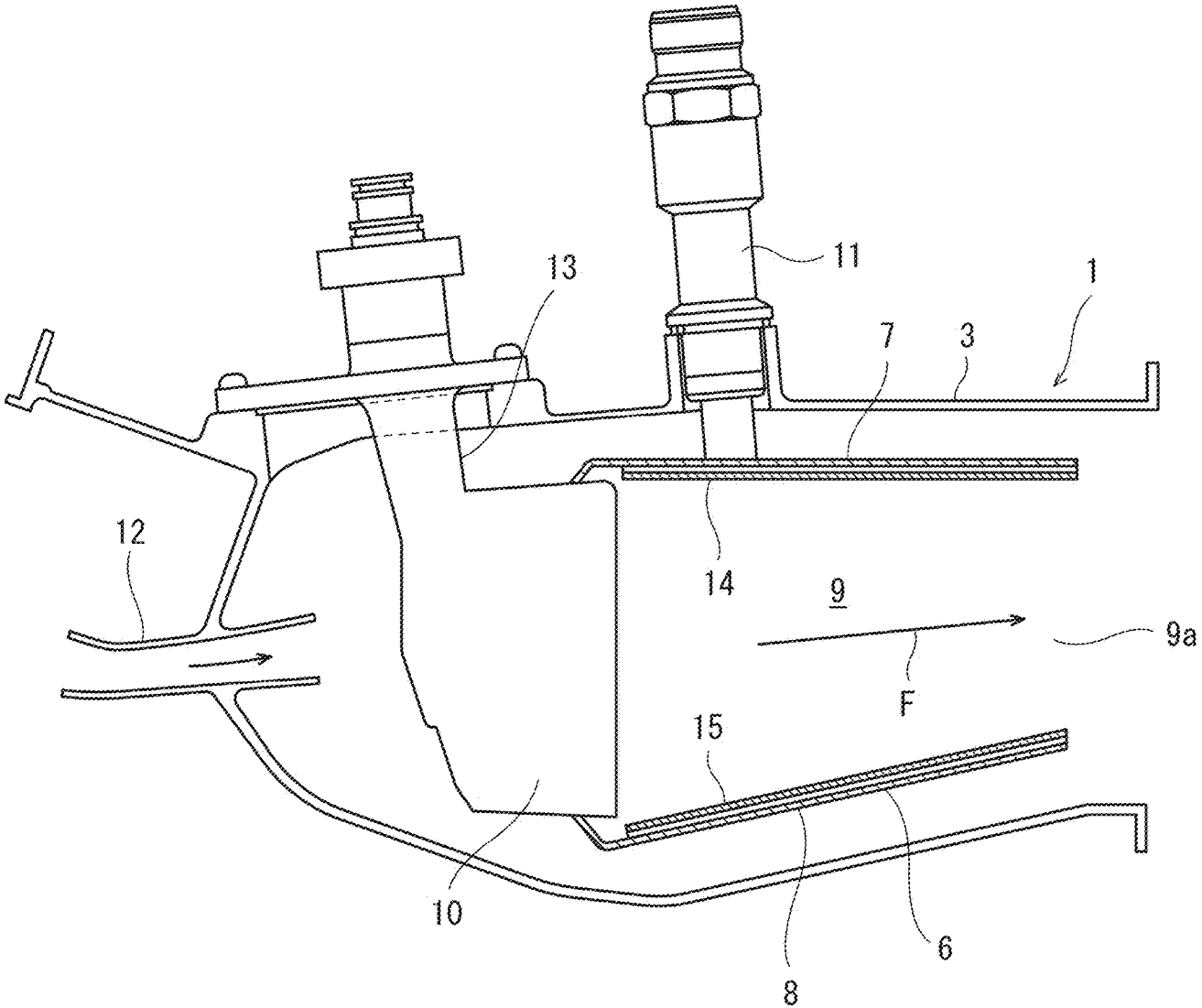
FIG. 2 is a sectional view taken along line II-II of FIG. 1 showing the combustor.

FIG. 2 is a sectional view taken along line II-II of FIG. 1 showing the combustor 2. In FIG. 2, a side where the ignition plug 11 is located is an outside in the radial direction R of the gas turbine 1, and a side where the center axis X is located is an inside in the radial direction R of the gas turbine 1. Moreover, a side where a diffuser 12 is located is the upstream side, and a side where the exhaust port 9*a* of the combustion chamber 9 is located is the downstream side. An inside of the shell 6 denotes an inside of the outer shell 7 in the radial direction and also denotes an outside of the inner shell 8 in the radial direction.

As shown in FIG. 2, the diffuser 12 is located at an upstream portion of the casing 3 and takes the compressed air, generated by the compressor, in the casing 3. The fuel injectors 10 are supported by a stem 13 fixed to the casing 3. Part of the compressed air which has been taken in the casing 3 is supplied to the fuel injectors 10 for combustion. The rest of the compressed air which has been taken in the casing 3 cools an outer surface of the shell 6, and part of the rest of the compressed air which has been taken in the casing is supplied as cooling air into the shell 6 through an opening 7*b* (see FIG. 4) of the shell 6.

A substantially cylindrical outer panel group 14 as a liner is located inside the cylindrical outer shell 7 in the radial direction R. A substantially cylindrical outer panel group 14 as a liner is located outside the cylindrical inner shell 8 in the radial direction R. The outer panel group 14 and the inner panel group 15 define the combustion chamber 9. The gas combusted in the combustion chamber 9 is discharged toward the turbine through the exhaust port 9*a* defined by a downstream end of the outer shell 7 and a downstream end of the inner shell 8.

Figure 3:
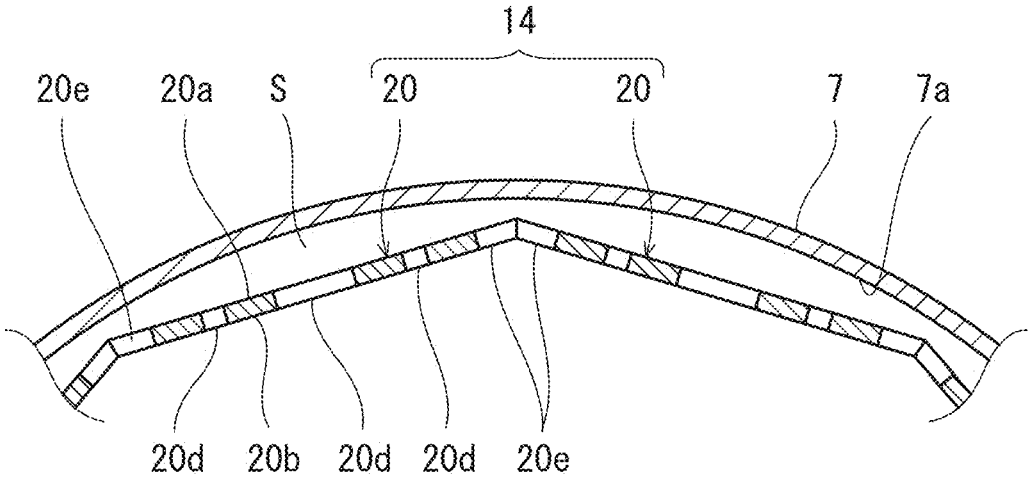
FIG. 3 is a partial sectional view showing the combustor of FIG. 2 when viewed in the flow direction.
Figure 4:
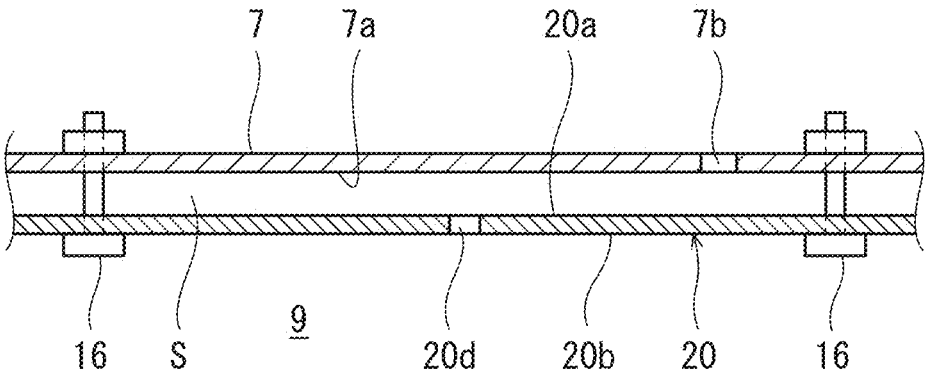
FIG. 4 is a partial sectional view showing the combustor of FIG. 3 when viewed in a circumferential direction.

FIG. 3 is a partial sectional view showing the combustor 2 of FIG. 2 when viewed in the flow direction F. FIG. 4 is a partial sectional view showing the combustor of FIG. 3 when viewed in the circumferential direction. As shown in FIG. 3, the outer panel group 14 is an assembly of panels 20 which are adjacently lined up to have a substantially cylindrical shape. The inner panel group 15 (see FIG. 2) is also an assembly of panels which are adjacently lined up to have a substantially cylindrical shape. Hereinafter, the outer panel group 14 will be mainly described.

The panels 20 are made of a ceramic matrix composite (CMC). The panels 20 are located inside the shell 6 and lined up in the circumferential direction C. As shown in FIG. 4, the panel 20 is attached to the outer shell 7 by fixtures 16 so as to be spaced apart from the outer shell 7. As one example, the fixture 16 includes a bolt and a nut. However, the configuration of the fixture 16 is not especially limited. The panel 20 includes an outer surface 20*a* and an inner surface 20*b*. The outer surface 20*a* is opposed to an inner peripheral surface 7*a* of the outer shell 7 so as to be spaced apart from the inner peripheral surface 7*a*. The inner surface 20*b* defines the combustion chamber 9 extending in the flow direction F from the upstream to downstream of the combustor 2. A space between the outer shell 7 and the panels 20 is utilized as a cooling air chamber S.

Figure 5:
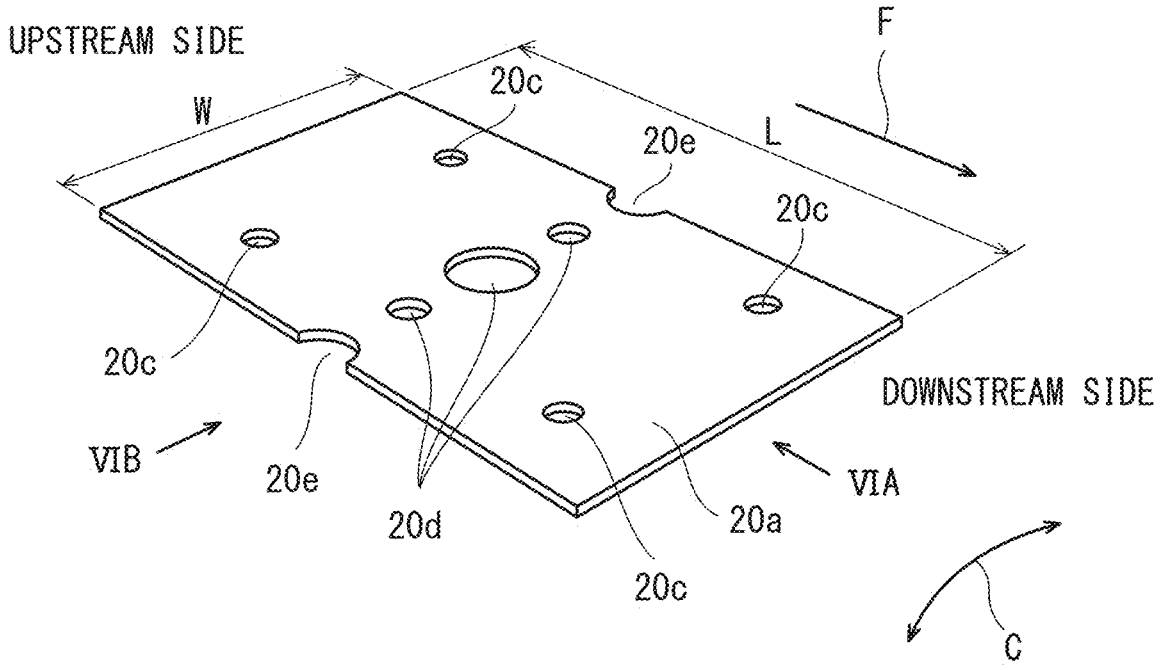
FIG. 5 is a perspective view of the panel of FIG. 4.
Figure 6A:
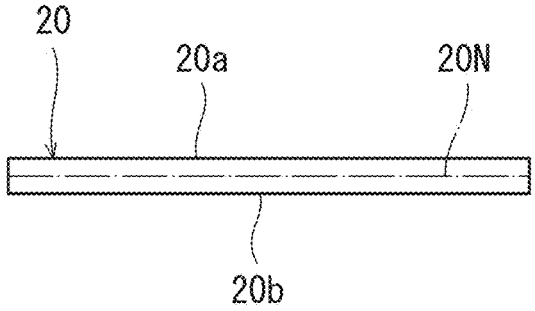
FIG. 6A is a diagram showing the panel of FIG. 5 when viewed in a direction VIA (from the downstream side).
Figure 6B:
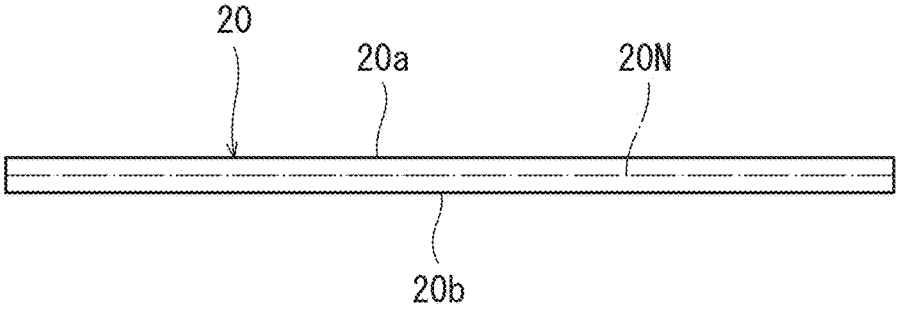
FIG. 6B is a diagram showing the panel of FIG. 5 when viewed in a direction VIB (in the circumferential direction).

FIG. 5 is a perspective view of the panel 20 of FIG. 5. FIG. 6A is a diagram showing the panel 20 of FIG. 5 when viewed in a direction VIA (from the downstream side). FIG. 6B is a diagram showing the panel of FIG. 5 when viewed in a direction VIB (in the circumferential direction). As shown in FIGS. 5, 6A, and 6B, a length L of the panel 20 in the flow direction F is longer than a width W of the panel 20 in the circumferential direction C. For example, the panel 20 may extend from an upstream end of the combustion chamber 9 to a downstream end of the combustion chamber 9 in the flow direction F. The panel 20 may extend from an upstream end of an inner peripheral surface of the shell 6 to a downstream end of the inner peripheral surface of the shell 6 in the flow direction F.

A neutral plane 20N between the outer surface 20*a* and inner surface 20*b* of the panel 20 has a planar shape. In the present embodiment, the panel 20 has a flat plate shape. To be specific, each of the outer surface 20*a* and the inner surface 20*b* has a planar shape. The panel 20 may be such that: the neutral plane 20N has a planar shape; and each of the outer surface 20*a* and the inner surface 20*b* has a non-planar shape.

The panel 20 includes attaching holes 20*c* into which the fixtures 16 are inserted. The panel 20 includes cooling holes 20*d*. The cooling holes 20*d* are lined up at intervals in the circumferential direction C of the panel 20. The number of cooling holes 20*d* does not have to be plural and may be one. The cooling holes 20*d* may be lined up in the flow direction F or may be lined up in both the circumferential direction C and the flow direction F. In the flow direction F, the cooling holes 20*d* are located between the attaching holes 20*c* at the upstream side and the attaching holes 20*c* at the downstream side. The panel 20 includes cutouts 20*c* located at end portions thereof in the circumferential direction C. When the cutouts 20*e* of a pair of panels 20 adjacent to each other are combined with each other, the cooling hole is formed.

Referring back to FIG. 4, the outer shell 7 includes the opening 7*b*. Part of the compressed air in the casing 3 (see FIG. 2) is supplied as the cooling air through the opening 7*b* to the cooling air chamber S. The pressure in the cooling air chamber S is higher than the pressure in the combustion chamber 9. Therefore, the cooling air in the cooling air chamber S flows out through the cooling holes 20*d* of the panel 20 to the combustion chamber 9. The cooling air which has flowed out through the cooling holes 20*d* covers the inner surface 20*b* of the panel 20 to reduce a temperature increase of the inner surface 20*b* of the panel 20 which is caused by the combustion gas in the combustion chamber 9.

Figure 7:
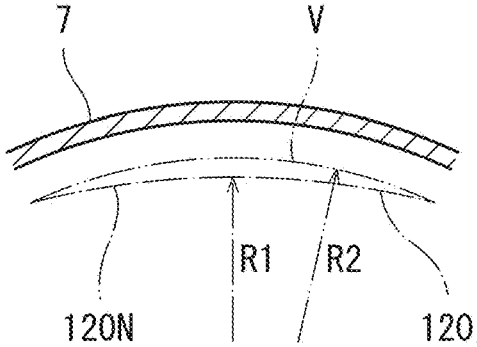
FIG. 7 is a diagram showing a modified example of the panel of FIG. 3.

FIG. 7 is a diagram showing a modified example of the panel 20 of FIG. 3. As shown in FIG. 7, a neutral plane 120N of a panel 120 of the modified example does not have to be a complete planar shape and may be a shape similar to the planar shape. For example, assumed is a virtual circular arc V which extends through both ends of the neutral plane 120N of the panel 120 in the circumferential direction C and is concentric with the inner peripheral surface 7*a* of the outer shell 7 when viewed in the flow direction F. The neutral plane 120N of the panel 120 may have a curved surface shape which extends in the circumferential direction C and whose curvature is smaller than the curvature of the virtual circular arc V. To be specific, the panel 120 may have such a curved surface shape that a curvature radius R1 of the neutral plane 120N is smaller than a curvature radius R2 of the virtual circular arc V.

According to the above-described configuration, since the panel 20 made of the ceramic matrix composite has a flat plate shape or a shape similar to a flat surface, restrictions by the shape of the panel 20 are reduced, and the stress of the panel 20 by the heat of the combustion chamber 9 can be reduced. Since the neutral plane 20N of the entire panel 20 has a planar shape, the stress of the panel 20 can be reduced by the simple shape. Since the length L of the panel 20 in the flow direction F is longer than the width W of the panel 20 in the circumferential direction C, the number of panels 20 is prevented from excessively increasing, and the productivity can be improved by simplifying the shape of the panel 20.

Embodiment 2

Figure 8:
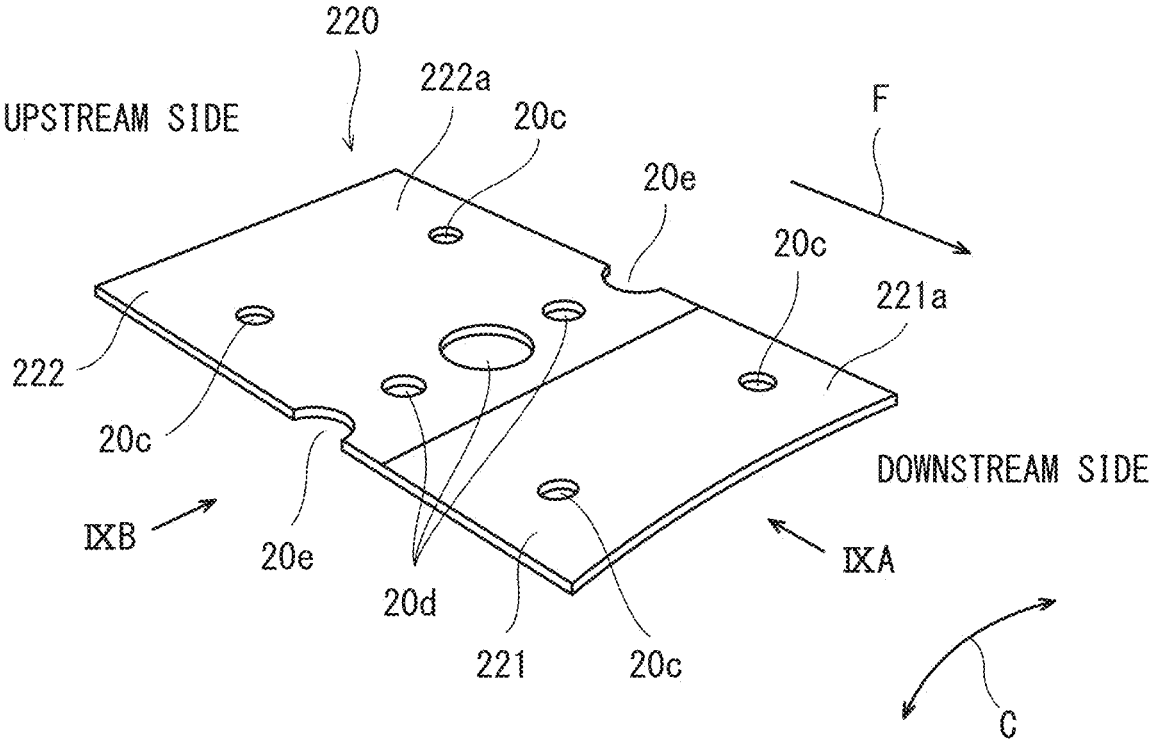
FIG. 8 is a perspective view of the panel of the combustor according to Embodiment 2.
Figure 9A:
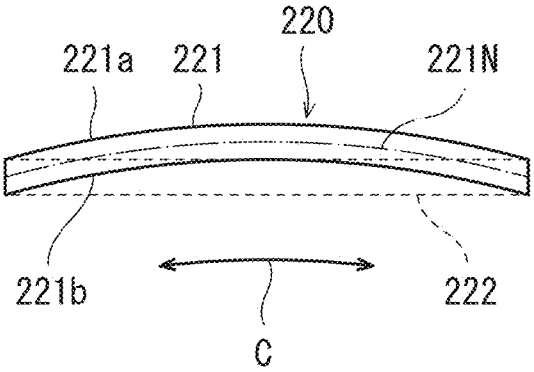
FIG. 9A is a diagram showing the panel of FIG. 8 when viewed in a direction IXA (from the downstream side).
Figure 9B:
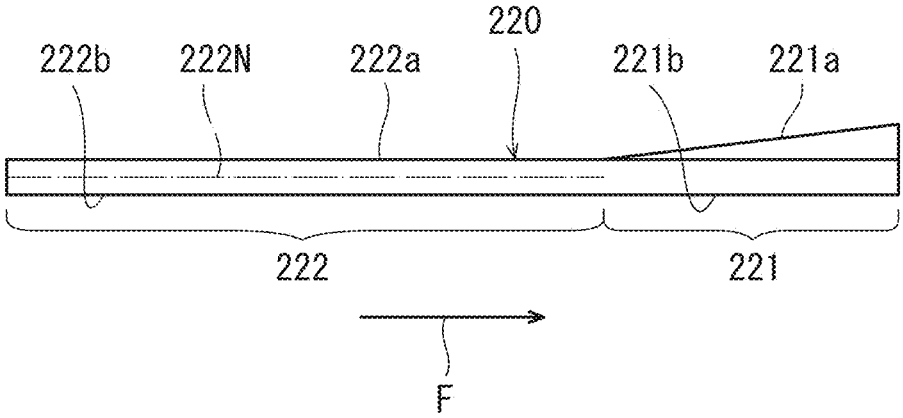
FIG. 9B is a diagram showing the panel of FIG. 8 when viewed in a direction IXB (in the circumferential direction).

FIG. 8 is a perspective view of a panel 220 of the combustor according to Embodiment 2. FIG. 9A is a diagram showing the panel 220 of FIG. 7 when viewed in a direction IXA (from the downstream side). FIG. 9B is a diagram showing the panel 220 of FIG. 7 when viewed in a direction IXB (in the circumferential direction). The same reference signs are used for the same components as in Embodiment 1, and explanations thereof are omitted. As shown in FIGS. 7, 8A, and 8B, the panel 220 includes sections 221 and 222 lined up in the flow direction F. Specifically, the panel 220 includes a first section 221 and a second section 222. The panel 220 is formed by integral molding using the ceramic matrix composite. A length of the panel 220 in the flow direction F is longer than a width of the panel 220 in the the circumferential direction C. For example, the panel 220 may extend from the upstream end of the combustion chamber 9 to the downstream end of the combustion chamber 9 in the flow direction F.

The first section 221 is adjacent to the downstream side of the second section 222. The first section 221 is continuous with the second section 222. A neutral plane 221N between an outer surface 221*a* and inner surface 221*b* of the first section 221 has a circular-arc curved surface shape extending in the circumferential direction C. In the present embodiment, the first section 221 has an arch plate shape.

A neutral plane 222N between an outer surface 222*a* and inner surface 222*b* of the second section 222 has a planar shape. In the present embodiment, the second section 222 has a flat plate shape. To be specific, each of the outer surface 222*a* and inner surface 222*b* of the second section 222 has a planar shape. The second section 222 may be such that: the neutral plane 222N has a planar shape; and each of the outer surface 222*a* and the inner surface 222*b* has a non-planar shape.

Moreover, the second section 222 may have a curved surface shape which extends in the circumferential direction C and whose curvature is smaller than an average curvature of the neutral plane 221N of the first section 221. The thickness of the second section 222 is the same as the thickness of the first section 221 but may be different from the thickness of the first section 221. The thicknesses of the first section 221 and the second section 222 are constant but may be changed.

The curvature of the neutral plane 221N of the first section 221 decreases as the neutral plane 221N approaches the second section 222 in the flow direction F. Conversely, the curvature of the neutral plane 221N of the first section 221 increases as the neutral plane 221N extends away from the second section 222 in the flow direction F. A change rate of the curvature of the first section 221 is constant in the flow direction F but may be changed.

As shown in FIG. 9A, the first section 221 is located such that when viewed in the flow direction F, a circumferential middle portion of the first section 221 projects relative to the second section 222 outward in the radial direction R. The amount of projection of the first section 221 relative to the second section 222 outward in the radial direction R increases as the first section 221 extends away from the second section 222.

A total region of the flat plate shape of the panel 220 is larger than a total region of the arch plate shape of the panel 220. A length of the total region of the flat plate shape of the panel 220 in the flow direction F is longer than a length of the total region of the arch plate shape of the panel 220 in the flow direction F. In the present embodiment, the second section 222 is larger than the first section 221. A length of the second section 222 in the flow direction F is longer than a length of the first section 221 in the flow direction F.

According to the above configuration, both of the formation of the curved surface of the panel 220 and the stress reduction of the panel 220 can be realized by the combination of the simple shapes. Moreover, since the curvature of the neutral plane 221N of the first section 221 decreases as the neutral plane 221N approaches the second section 222 in the flow direction F, the panel 220 is prevented from having a distorted shape, and this contributes to the stress reduction of the panel 220. Since the other components are the same as those in Embodiment 1, explanations thereof are omitted.

Figure 10A:
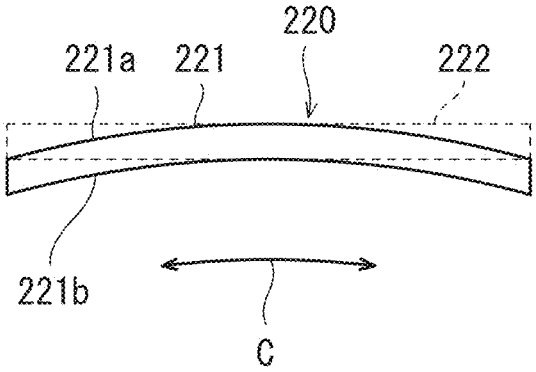
FIG. 10A is a diagram showing a modified example of the panel of FIG. 9A and corresponding to FIG. 9A.
Figure 10B:
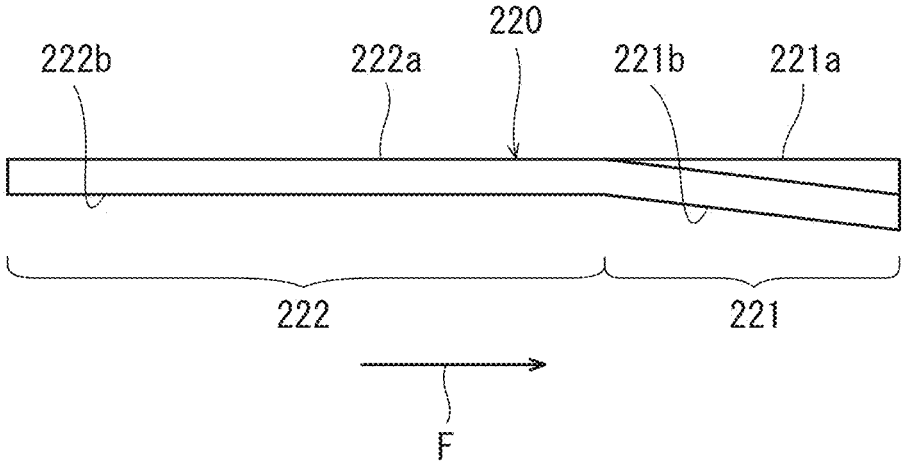
FIG. 10B is a diagram showing the panel of FIG. 10A and corresponding to FIG. 9B.

FIG. 10A is a diagram showing a modified example of the panel 220 of FIG. 9A and corresponding to FIG. 9A. FIG. 10B is a diagram showing the panel 220 of FIG. 10A and corresponding to FIG. 9B. As shown in FIGS. 10A and 10B, the first section 221 may be located such that when viewed in the flow direction F, both circumferential end portions of the first section 221 project relative to the second section 222 inward in the radial direction R. The amount of projection of the first section 221 relative to the second section 222 inward in the radial direction R increases as the first section 221 extends away from the second section 222. According to this configuration, a uniform gap can be easily formed between the panel 220 and the shell 6 (see FIG. 2).

Embodiment 3

Figure 11:
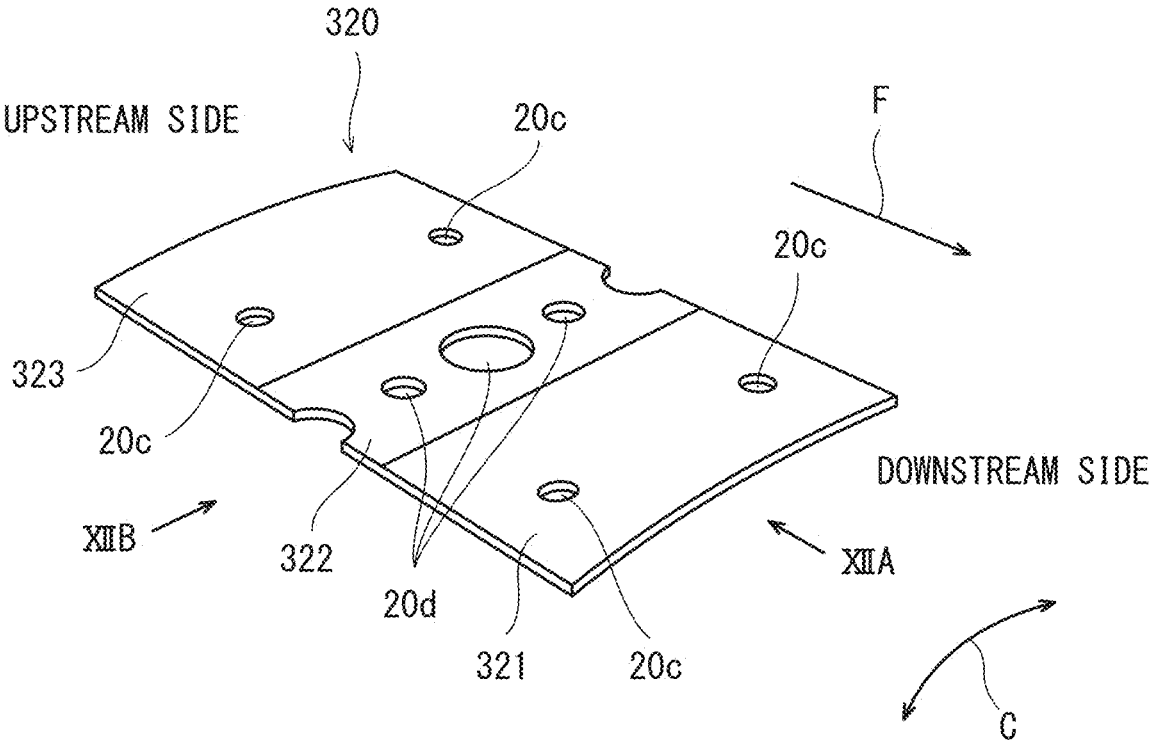
FIG. 11 is a perspective view of the panel of the combustor according to Embodiment 3.
Figure 12A:
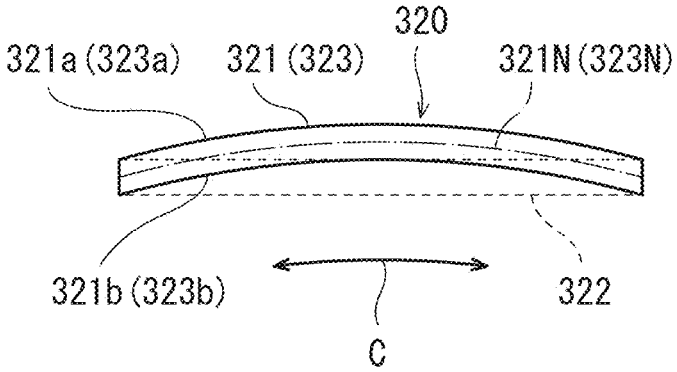
FIG. 12A is a diagram showing the panel of FIG. 11 when viewed in a direction XIIA (from the downstream side).
Figure 12B:
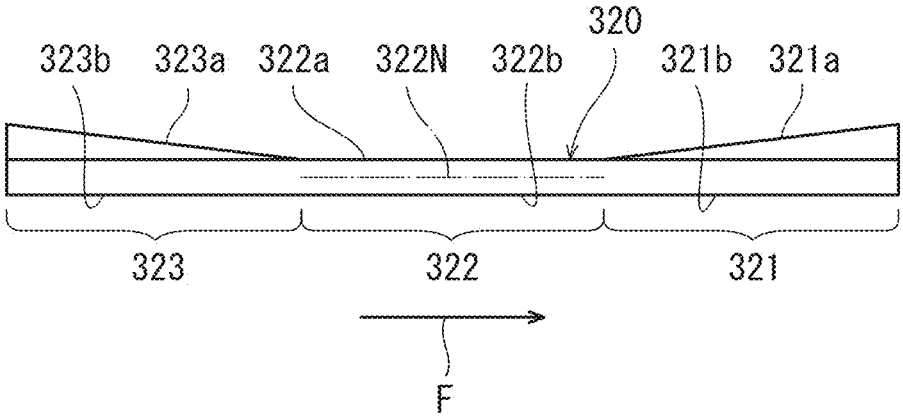
FIG. 12B is a diagram showing the panel of FIG. 11 when viewed in a direction XIIB (in the circumferential direction).

FIG. 11 is a perspective view of a panel 320 of the combustor according to Embodiment 3. FIG. 12A is a diagram showing the panel of FIG. 11 when viewed in a direction XIIA (from the downstream side). FIG. 12B is a diagram showing the panel of FIG. 11 when viewed in a direction XIIB (in the circumferential direction). The same reference signs are used for the same components as in Embodiment 1, and explanations thereof are omitted. As shown in FIGS. 11, 12A, and 12B, the panel 320 includes sections 321 to 323 lined up in the flow direction F. Specifically, the panel 320 includes a first section 321, a second section 322, and a third section 323. The panel 220 is formed by integral molding using the ceramic matrix composite. A length of the panel 320 in the flow direction F is longer than a width of the panel 320 in the circumferential direction C. For example, the panel 320 may extend from the upstream end of the combustion chamber 9 to the downstream end of the combustion chamber 9 in the flow direction F.

The first section 321 is adjacent to the downstream side of the second section 322. The third section 323 is adjacent to the upstream side of the second section 322. The first section 321 and the third section 323 are continuous with the second section 322. Each of a neutral plane 321N of the first section 321 and a neutral plane 323N of the third section 323 has a circular-arc curved surface shape extending in the circumferential direction C. In the present embodiment, each of the first section 321 and the third section 323 has an arch plate shape.

A neutral plane 322N between an outer surface 322*a* and inner surface 322*b* of the second section 322 has a planar shape. In the present embodiment, the second section 322 has a flat plate shape. The second section 322 may be such that: the neutral plane 322N has a planar shape; and each of the outer surface 322*a* and the inner surface 322*b* has a non-planar shape. Moreover, the second section 322 may have a curved surface shape which extends in the circumferential direction C and whose curvature is smaller than an average curvature of the neutral plane 321N of the first section 321. Each of the thicknesses of the first section 321 and the third section 323 is the same as the thickness of the second section 322 but may be different from the thickness of the second section 322. Each of the thicknesses of the first to third sections 321 to 323 is constant but may be changed.

The shape of the neutral plane 321N between an outer surface 321*a* and inner surface 321*b* of the first section 321 and the shape of the neutral plane 323N between an outer surface 323*a* and inner surface 323*b* of the third section 323 may be symmetric with respect to the second section 322. A length of the first section 321 in the flow direction F may be the same as a length of the third section 323 in the flow direction F but may be different from the length of the third section 323 in the flow direction F. The curvature of the neutral plane 321N of the first section 321 and the curvature of the neutral plane 323N of the third section 323 decrease as the neutral plane 321N and the neutral plane 323N approach the second section 322 in the flow direction F. Change rates of the curvatures of the first section 321 and the third section 323 are constant in the flow direction F but may be changed.

As shown in FIG. 12A, the first section 321 may be located such that when viewed in the flow direction F, a circumferential middle portion of the first section 321 projects relative to the second section 322 outward in the radial direction R, and the third section 323 may be located such that when viewed in the flow direction F, a circumferential middle portion of the third section 323 projects relative to the second section 322 outward in the radial direction R. Or, the first section 321 may be located such that when viewed in the flow direction F, both circumferential end portions of the first section 321 project relative to the second section 322 inward in the radial direction R, and the third section 323 may be located such that when viewed in the flow direction F, both circumferential end portions of the third section 323 project relative to the second section 322 inward in the radial direction R.

A total region of the flat plate shape of the panel 320 is smaller than a total region of the arch plate shape of the panel 320. A length of the total region of the flat plate shape of the panel 220 in the flow direction F is shorter than a length of the total region of the arch plate shape of the panel 220 in the flow direction F. In the present embodiment, the second section 322 is larger than the total of the first section 321 and the third section 323. A length of the second section 322 in the flow direction F is longer than the total of a length of the first section 321 and a length of the third section 3233 in the flow direction F.

According to the above configuration, both of the formation of the curved surface of the panel 320 and the stress reduction of the panel 320 can be realized by the combination of the simple shapes. Moreover, since the curvature of the neutral plane 321N of the first section 321 and the curvature of the neutral plane 323N of the third section 323 decrease as the neutral plane 321N and the neutral plane 323N approach the second section 322 in the flow direction F, the panel 320 is prevented from having a distorted shape, and this contributes to the stress reduction of the panel 320. Since the other components are the same as those in Embodiment 1, explanations thereof are omitted.

Figure 13A:
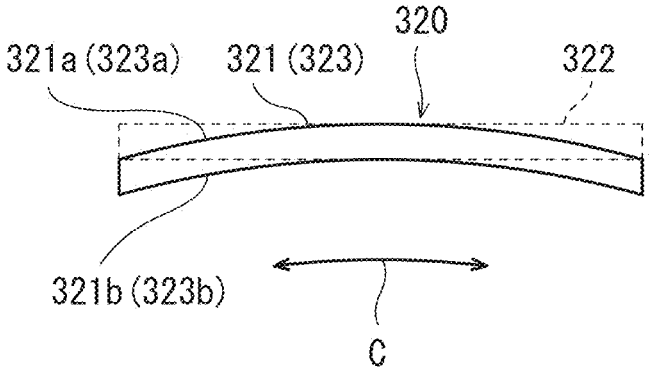
FIG. 13A is a diagram showing a modified example of the panel of FIG. 12A and corresponding to FIG. 12A.
Figure 13B:
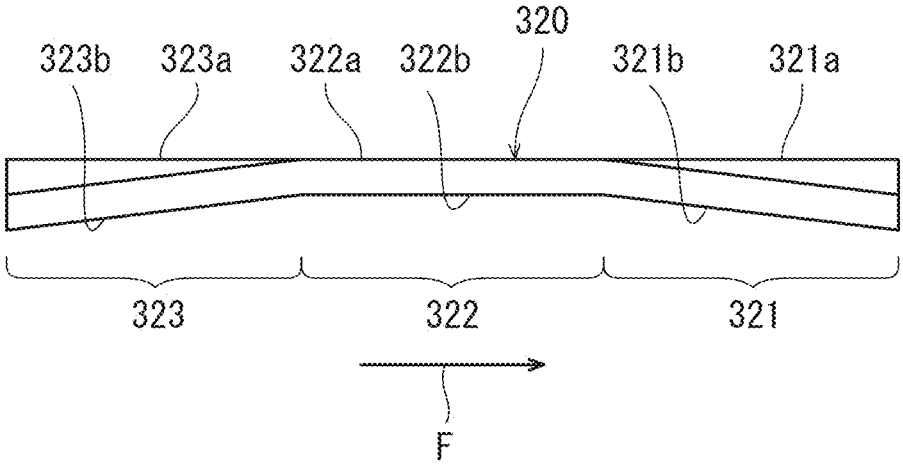
FIG. 13B is a diagram showing the panel of FIG. 13A and corresponding to FIG. 12B.

FIG. 13A is a diagram showing a modified example of the panel 320 of FIG. 12A and corresponding to FIG. 12A. FIG. 13B is a diagram showing the panel 320 of FIG. 13A and corresponding to FIG. 12B. As shown in FIGS. 13A and 13B, the first section 321 may be located such that when viewed in the flow direction F, both circumferential end portions of the first section 321 project relative to the second section 322 inward in the radial direction R. Similarly, the third section 323 may be located such that when viewed in the flow direction F, both circumferential end portions of the first section 323 project relative to the second section 322 inward in the radial direction R. The amount of projection of the first section 321 relative to the second section 322 inward in the radial direction R and the amount of projection of the third section 323 relative to the second section 322 inward in the radial direction increase as the first section 321 and the third section 323 extend away from the second section 322. According to this configuration, a uniform gap can be easily formed between the panel 320 and the shell 6 (see FIG. 2).

The foregoing has described the embodiments as examples of the technology disclosed in the present application. However, the technology in the present disclosure is not limited to these and is applicable to embodiments in which modifications, replacements, additions, omissions, and the like have been suitably made. Moreover, a new embodiment may be prepared by combining the components described in the above embodiments. For example, some of components or methods in one embodiment may be applied to another embodiment. Some components in an embodiment may be separated from the other components in the embodiment and arbitrarily extracted. Furthermore, the components shown in the attached drawings and the detailed explanations include not only components essential to solve the problems but also components for exemplifying the above technology and not essential to solve the problems.

The invention claimed is:

1. A panel of a combustor of a gas turbine, the panel being one of panels located inside a cylindrical shell of the combustor and lined up in a circumferential direction, the panel including a ceramic matrix composite, the panel comprising:

an outer surface that is opposed to an inner peripheral surface of the cylindrical shell so as to be spaced apart from the inner peripheral surface of the cylindrical shell;

an inner surface that defines a combustion chamber extending in a flow direction from an upstream side of the combustor to a downstream side of the combustor;

a first section and a second section lined up in the flow direction, wherein:

the first section includes a first neutral plane, between the outer surface and the inner surface, having a curved surface shape extending in the circumferential direction;

the second section is at an upstream-most portion of the panel and includes a second neutral plane, between the outer surface and the inner surface, having a planar shape; and the first section is adjacent to a downstream side of the second section.

2. The panel according to claim 1, wherein the first section has an arch plate shape, and the second section has a flat plate shape.

3. The panel according to claim 1, wherein:

the first section is continuous with the second section while being adjacent to the second section in the flow direction; and a curvature of the first neutral plane of the first section decreases as the first neutral plane of the first section approaches the second section in the flow direction.

4. The panel according to claim 1, wherein a length of the panel in the flow direction is longer than a width of the panel in the circumferential direction.

5. A combustor of a gas turbine, the combustor comprising:

a cylindrical shell; and panels located inside the cylindrical shell, lined up in a circumferential direction, and including a ceramic matrix composite, at least one of the panels being the panel according to claim 1.

6. The combustor according to claim 5, wherein the panels extend in the flow direction from an upstream end of the combustion chamber to a downstream end of the combustor chamber.

* * * * *